United States Patent [19]

Bückle

[11] Patent Number: 5,056,730

[45] Date of Patent: Oct. 15, 1991

[54] APPARATUS AND PROCESS FOR TAKING UP A WEB OF FABRIC BY MEANS OF A CENTERED WINDER PLACED AFTER A WEAVING MACHINE

[76] Inventor: Hugo Bückle, Sulzbachweg 5, 7900 Ulm, Fed. Rep. of Germany

[21] Appl. No.: 422,616

[22] Filed: Oct. 17, 1989

[51] Int. Cl.[5] ..... B65H 23/10

[52] U.S. Cl. ..... 242/75.2; 242/67.1 R

[58] Field of Search ..... 242/67.1 R, 66, 75.2, 242/65, 67.2

[56] References Cited

U.S. PATENT DOCUMENTS

| | | | |
|---|---|---|---|
| 1,946,801 | 2/1934 | Malkin et al. | 242/66 |
| 2,957,639 | 10/1960 | Muller | 242/75.2 |
| 3,410,499 | 11/1968 | Schmidt | 242/67.1 R |
| 3,707,996 | 1/1973 | Zebley et al. | 242/75.2 X |
| 3,730,450 | 5/1973 | Hank | 242/66 |
| 3,762,662 | 10/1973 | Owens et al. | 242/75.2 |
| 3,904,145 | 9/1975 | Steinberger et al. | 242/75.2 |
| 4,199,117 | 4/1980 | Muller et al. | 242/75.2 |
| 4,524,919 | 6/1985 | Wehrmann | 242/67.1 R |

*Primary Examiner*—John M. Jillions

*Attorney, Agent, or Firm*—Edwin D. Schindler

[57] ABSTRACT

An apparatus and process is disclosed in which a web of fabric is conveyed to a centered winder having control of the tensile stress of the fabric to relatively low stress values, and shortly before arranging at the winder, the web of fabric is placed under increased tensile stress by braking. More particularly, the formation of folds is first opposed at low tensile stress before arrival of the web of fabric at the winder. During the winding process itself, the fabric, which is still under slight stress, is applied onto a winding drum and smoothed and is, at the same time, placed under high tensile stress by braking. The individual values of the tensile stress are governed by the material of which the fabric is made and by the construction of the fabric.

15 Claims, 5 Drawing Sheets

APPARATUS AND PROCESS FOR TAKING UP A WEB OF FABRIC BY MEANS OF A CENTERED WINDER PLACED AFTER A WEAVING MACHINE

BACKGROUND OF THE INVENTION

1. Technical Field of the Invention

The present invention generally to an apparatus and process for taking up a web of fabric. More particularly, the present invention relates to an apparatus and process for taking up a web of fabric, especially one made of an industrial fabric, using, for example, glass, aramid or carbon fibers, on a take-up drum of a centered winder, which is placed after a weaving machine.

2. Description of the Prior Art

In taking up webs of fabric on a winder, difficulties often arise in keeping the web uniformly smooth. For one thing, the axes of the rolls, which work together, must be arranged exactly parallel to each other and, as far as possible, they must have no play in their motion. Secondly, in the case of thick fibers or yarns made of stiff or rigid materials, the winding must be done under high tensile, in order to keep the web of fabric taut and firmly against the roll.

In conventional processes known to the prior art, tensile stress of the web of fabric in the convey-in region from the weaving machine to the centered winder is usually kept at approximately the same values as during the winding process itself. At these high tensile stresses, folds are easily formed along the path, approximately 6 m in length, from the weaving machine to the winder. Under high tensile stress, and possible pressing which follows, these folds become fixed and are retained until they reach the roll of fabric.

Indeed, it is known to bring about a limited balancing of tension within the fabric by a traversing motion. However, it is not possible, in this manner, to eliminate the folds, once they have formed and have then been pressed firmly.

SUMMARY OF THE INVENTION

It is, therefore, an object of the present invention to provide an apparatus and process for taking up a web of fabric by means of a centered winder placed after, for example, a weaving machine which achieves a substantially fold-free and smooth take-up of webs of fabric onto rolls.

It is a further object of the present invention to provide an apparatus and process, as heretofore described, which may be carried out in an economic and efficient manner.

The foregoing and related objects are achieved by an apparatus and process wherein a web of fabric is conveyed to a centered winder, with control of its tensile stress to relatively low stress values, and shortly before arriving at the winder, the web of fabric is placed under increased tensile stress by braking.

In this manner, the formation of folds is first opposed at low tensile stress before arrival of the web of fabric at the winder. During the winding process itself, the fabric, which is still under slight stress, is applied onto a winding drum and smoothed and is, at the same time, placed under high tensile stress by braking.

The individual values of the tensile stress are governed by the material of which the fabric is made and by the construction of the fabric. The harder the material of the fabric and the thicker the fibers and/or yarns, the stronger can be the stress applied. With fine fabrics, correspondingly smaller forces must be used. In order to be able to measure the effective forces here, the braking force during the braking of the web of fabric should be adjusted to predetermined values.

A further release of stress and equilibration of the fabric can be achieved if the web of fabric is guided so as to oscillate back and forth in its own plane perpendicularly to the running direction at one place in its longitudinal path prior to the braking, i.e., by a traversing motion. The braking and the traversing motion can basically be effected in any suitably known manner. To the extent possible, both should be caused to occur.

The present invention further relates to an apparatus which, preferably, is provided to carry out the process described above, and is intended for taking up a web of fabric, especially one made of industrial fabrics using glass, aramid or carbon fibers, on a winding drum of a centered winder placed after a weaving machine, where the centered winder has a winding drum that can be rotated about a fixed axis, and to which the web of fabric is conveyed from the weaving machine via a device for controlling its tensile stress, with a pressure roller lying against the circumference of the winding drum and parallel thereto wherein, in accordance with the present invention, a brake acting on the web of fabric is provided shortly before the arrival of the web of fabric at the winding drum.

The brake of the invention, located ahead of the drum, makes it possible to guide the fabric to the pressure roller with low stress and, thus, to avoid the formation of folds. Only by the braking process is there a build-up of the tensile stress required for a smoothing of the web of fabric, when the latter is already at least partially lying on the winder or winding drum, and can be pulled smooth thereon. Then the fabric can also be pressed onto the winding drum and, thus, further smoothed. The forces to be applied here, like the braking forces, are dependent on the nature of the fabric, i.e., on the material of which it is made and the construction of the web of fabric, and should be capable of sensitive control, to the extent possible, by means of control devices.

In this connection, significance is also attached to the tensional relationship between the web of fabric and the pressure roller, which can be assured by a wrapping angle of more than 240°, preferably more than 260°.

Thus, the web of fabric can be guided over a thin contact roller until it is close to the circumference of the winding roller, whereupon it is further conveyed around the contact roller and then around the pressure roller, and through the entrance between the latter and the rolled web of fabric, i.e., the wrapping of the fabric web, at its circumference.

Other objects and features of the present invention will become apparent to those skilled in the art when the present invention is considered in view of the accompanying drawing figures. It should, of course, be recognized that the accompanying drawing figures illustrate a preferred embodiment of the present invention and are not intended as a means for defining the limits and scope of the present invention.

BRIEF DESCRIPTION OF THE DRAWING

In the drawing figures, wherein similar reference numerals denote similar features throughout the several views.

DETAILED DESCRIPTION OF THE DRAWING AND PREFERRED EMBODIMENTS

Figure 1:
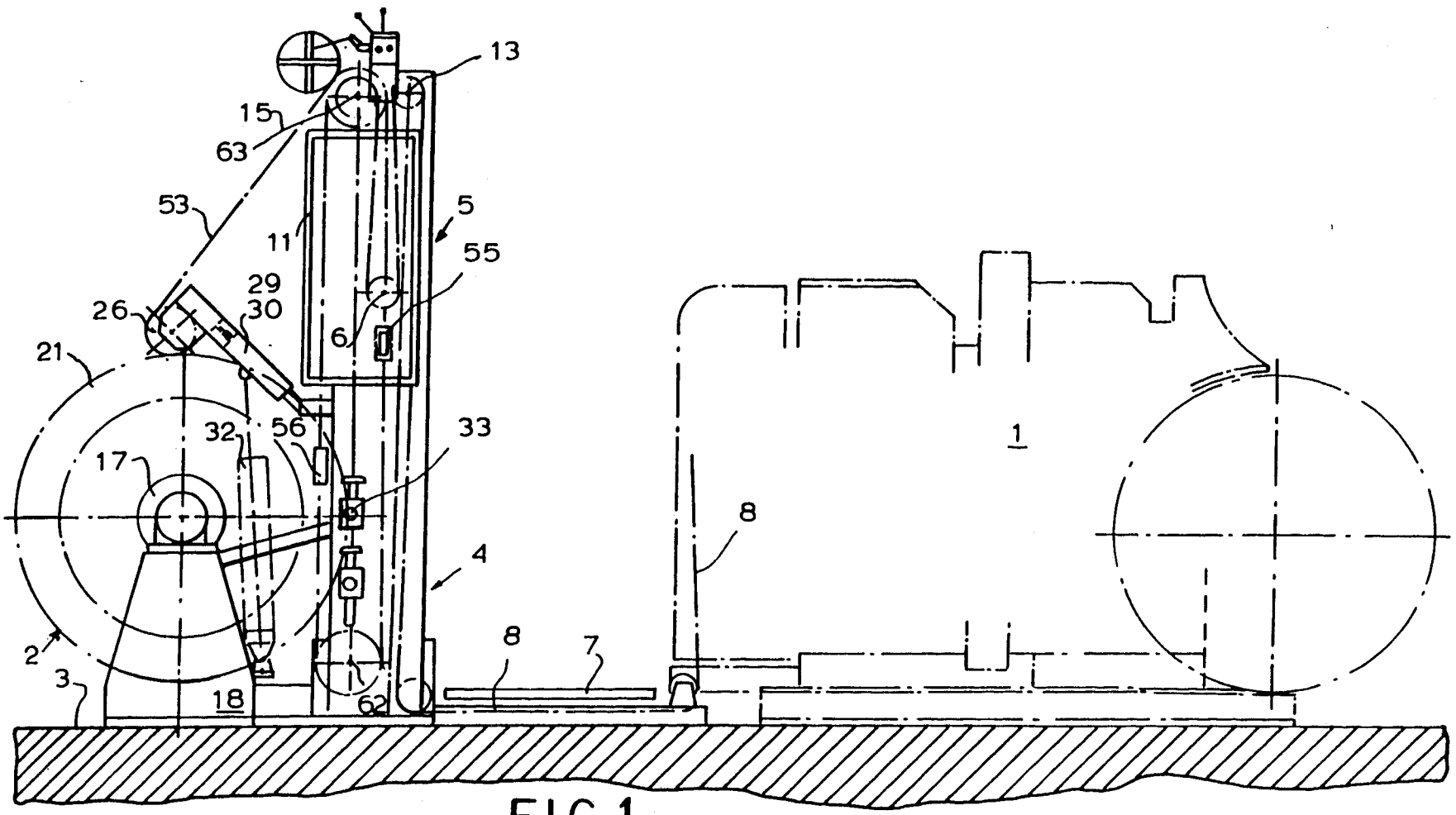
FIG. 1 shows a schematic side view of a winding device of the present invention with a centered winder placed after a weaving machine.

Turning now, in detail, to the drawing figures, FIG. 1 shows a weaving machine (1), which is firmly mounted at a distance from a centered winder (2) on the same floor surface (3). Between the two machines, close to the centered winder (2), is placed a housing (4), which extends upward and which contains a switch cabinet (11) and also holds a dancer roller arrangement (5), with a dancer roller (6), for controlling the tensile stress of a web of fabric. The further distance between the two machines is covered over by a footbridge (7), under which the web of fabric (8) is guided from the exit roller (9) of the weaving machine (1) to the entrance roller (10) of the dancer roller arrangement (5).

From there, the web of fabric (8) runs upward to a traversing roller (13), and thence downward to the variable-height dancer roller (6) and over the elevated reversing roller (15) to the centered winder (2). As can best be seen from FIG. 3, this centered winder has a winding shaft (16) which can rotate around a winding axis (14) and which is mounted at both ends in tilting bearings (17) located on floor frames (18). The tilting bearings (17) can be tilted outward to permit removal of the winding shaft (16) from the housing of the centered winder.

A winding drum (20) preferably shaped in the manner of a cored tube is mounted on winding shaft (16) by means of two mutually supportable end disks (19). This winding drum is usually made of a light and economical material of construction, preferably of plastic-reinforced cardboard, and serves for building up the roll of fabric (21). The winding shaft (16) with the roll of fabric (21) is driven by a stepless-control electric motor (24) by means of a chain drive (25).

Figure 2:
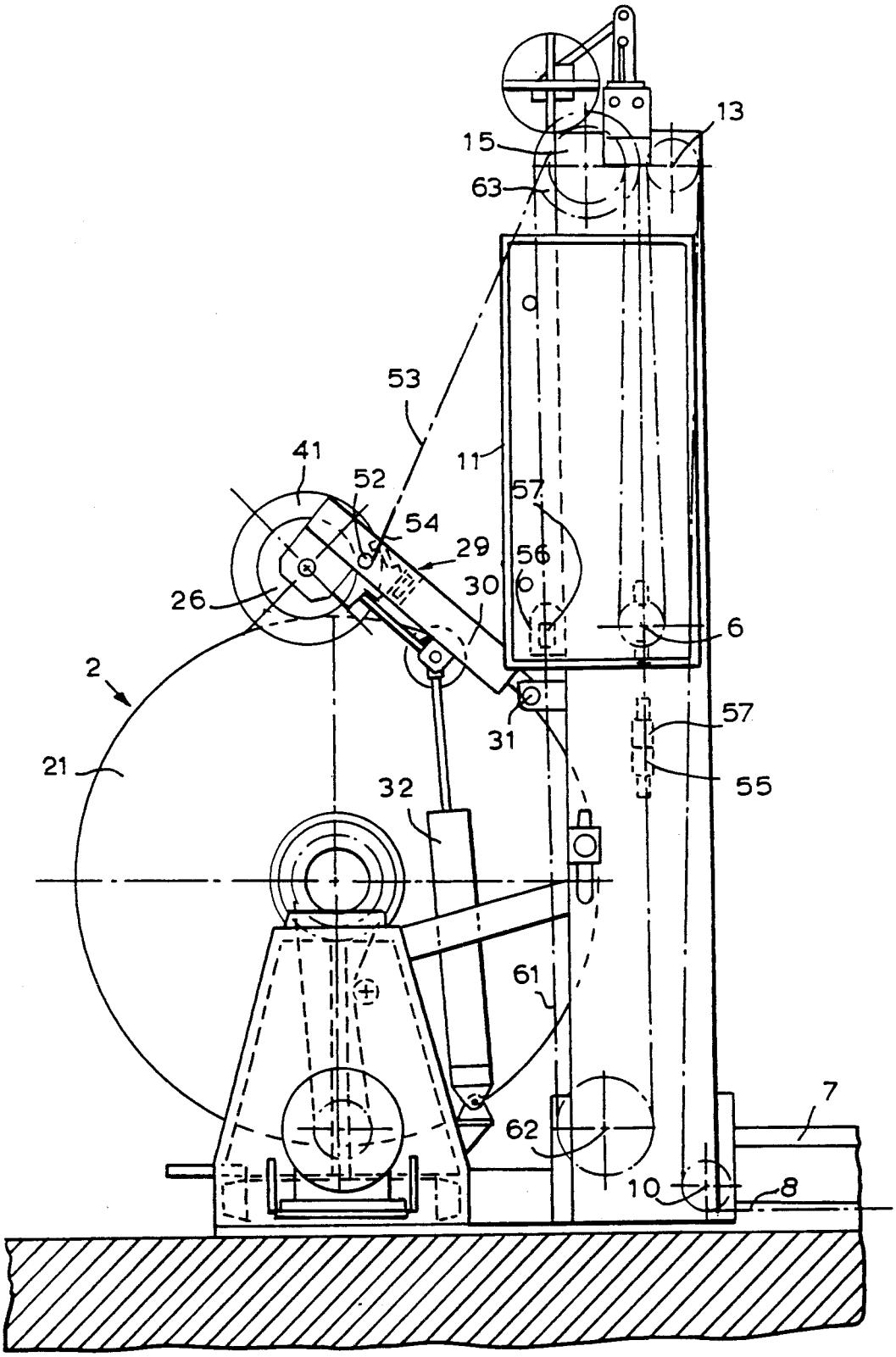
FIG. 2 shows an enlarged representation of a portion of the centered winder provided with a braking device for the web of fabric.
Figure 3:
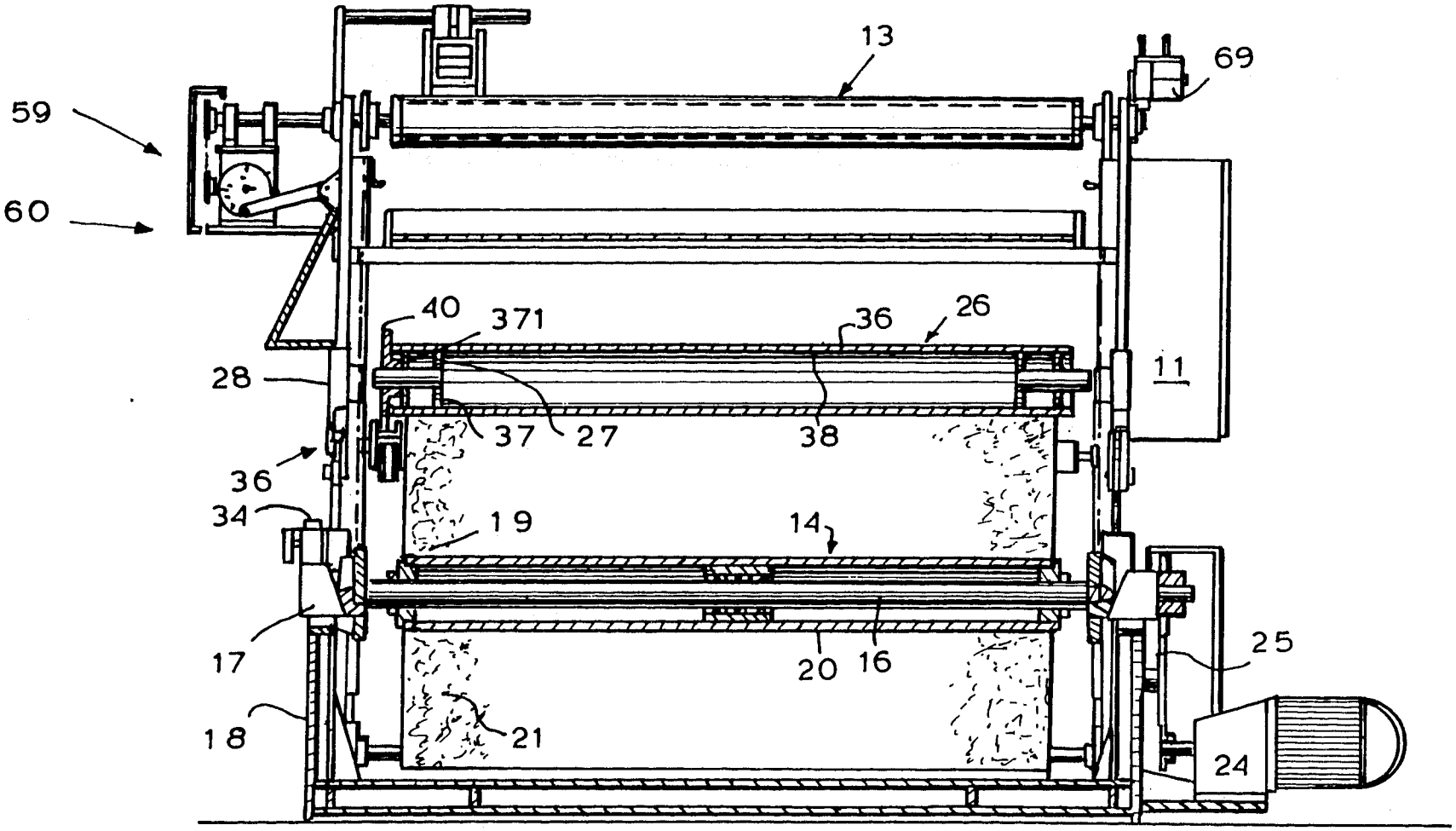
FIG. 3 shows a sectional view through the centered winder along the line III—III of FIG. 2.
Figure 4:
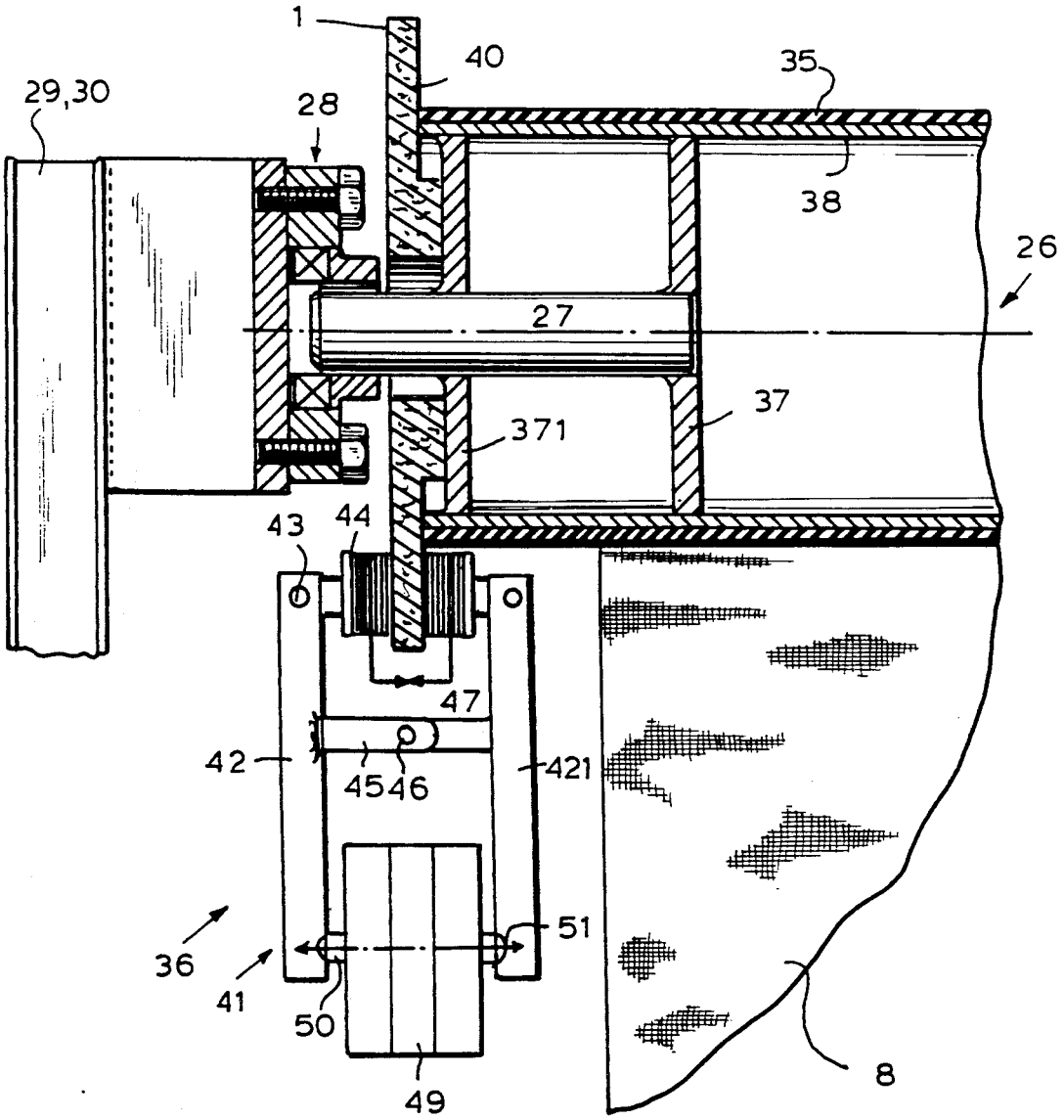
FIG. 4 shows a sectional view through the brake for the web of fabric along the IV—IV line of FIG. 2; and, FIG. 5 is a pneumatic circuit plan, which may be employed for carrying out the present invention.

As can further be seen in FIGS. 2 to 4, a pressure roller (26) runs on the roll of fabric (21). This pressure roller carries a bearing bolt (27) at each end, which projects detachably into a bearing (28) at the free end of a rocker mounting (29). The rocker mounting can be made up of two levers (30) connected to each other; each of which is preferably rotatably mounted in bearings (31) on the housing (4). Of course, two unconnected levers (30) can also be provided, these indeed being connected by the pressure roller itself and being centered and extended on the latter.

The height of the pressure roller (26) is adjusted by at least one compressed air cylinder (32), which is connected to the floor frame (18) and grasps the rocker mounting (29) at a distance from its bearings (31). This compressed air cylinder (32) can basically be designed to be double-acting; as a general rule, an equidirectional exertion of pressure serves to lift the pressure roller (26) from the roll of fabric (21). In this manner, the pressure between the pressure roller and the roll of fabric can be increased or decreased by adjusting the pressure control valve (33) located ahead of the cylinder (32).

The construction of the pressure roller (26) with a brake (36) for the web of fabric can best be seen in FIG. 4.

The drum tube (38), stiffened by partitioning disks (37, 371), is enclosed in a rubber covering (39). A bearing bolt welded into two adjoining partitioning disks (37, 371) projects into the bearing (28) provided in the rocker mounting (29), as described above. The pressure roller can, thus, rotate freely regardless of its height and the inclination of the rocker mounting (29).

The brake (36) for the web of fabric includes a brake disk (40) detachably fastened centrically to an outside partitioning disk (371); this braking disk (40) acting together with a brake caliper (41). The latter includes, preferably, two mirror-image longitudinal levers (42, 421) which are connected with each other and carry attached brake pads (44) at their upper ends in linkages (43). These levers are connected to each other by means of inwardly projecting crossbars (45) through a knee linkage (46). As can be seen from the double arrow (47) in the line connecting the two brake pads (44), these are pre-stressed inwardly. The engagement of the brake can also be balanced by rubber blocks or similar intermediate bodies.

Between the free ends of the longitudinal levers (42, 421) is inserted a short-path, compressed-air cylinder (49), which serves as the activating device. By means of rounded-end bolts (50) mounted externally at both sides, this cylinder engages in corresponding recesses (51) in the longitudinal levers, in a self-centering manner.

The air pressure in the cylinder (49) is automatically adjusted, by means of a separate control valve (34), to a value prescribed by the nature of the web of fabric. In this way, by the running of the web of fabric (8) onto the roll, and still earlier onto the pressure roller (26), this part and the part of the web of fabric (8), which is next to wrap around the roll, are braked. From the first braking action onward, this web is placed under considerably higher tensile stress by the retarding forces and, thus, the formation of a uniformly fold-free, smooth and firm roll of fabric (21) is assured.

It is important for the braking process to have a firm frictional connection of the web of fabric (8) with the pressure roller. This effect is increased here by a contact roller (52) which pulls the entering web leader (53) downward ahead of the pressure roller (26), so that it must then be guided around the pressure roller by about 260°, until it again becomes unstressed at the lower line of contact between the roll of fabric (21) and the pressure roller (26), but is tensioned firmly around the outside surface of the roll of fabric.

The uniformity of the roll of fabric is increased further, preferably, by the traversing device (59). Its traversing roller (13) carries out a back-and-forth oscillating movement along its axis as the web of fabric passes through. As represented in FIG. 3, this movement is generated by a disk drive (60). In this manner, stresses in the fabric are decayed and the nature of the fabric is improved over its entire width.

Here, the mounting of the dancer roller (6) is connected to an endless chain (61), adjustable between sprocket wheels (62) and (63) and carrying take-up devices (55, 56) for dancer weights (57). The action of the weights of the dancer roller (6) is reinforced by weights of the first take-up device, and it is diminished by weights in the second take-up device (56). Reinforcement, in turn, should be considered with strong fabrics, and diminution with fine or tension-sensitive fabrics. In any event, the tensile load can be exactly adjusted, and the stress can be balanced, in this manner.

In this connection, a further improvement arises from the transverse compression of the fabric between pressure rollers (26) and the roll of fabric (21). When winding starts on the thin winding drum (20), which is still lightly covered with fabric, the pressure is large (also as a consequence of the smaller radius of curvature of the roll); it decreases when the diameter of the roll is large. A compensation is achieved here owing to the fact that the "winding drum" usually includes a cardboard or pasteboard tube and is therefore relatively compliant under pressure. In this concept, however, the important source of the smoothing and balancing of the web of fabric derives from the braking process which occurs at each moment as the web of fabric arrives at the pressure roller.

As a general rule, the dancer weights can now be used to adjust or to control the tension of the web of fabric between the place where the fabric is formed in the weaving machine and the entrance into the centered winder. Starting from this basic tension, the greater tension needed for the winding process is then achieved in that a definite additional tension is applied by means of the brake for the web of fabric. It is, therefore, essential that both tensions should be separately capable of the most exact adjustment possible; pneumatic valves are preferably suitable for this purpose. In combination with compression and traversing motion, however, the braking process assumes the greater significance.

Although preference is given to pneumatic control in combination with the pneumatic application of force, nevertheless any other activating device and motor system can be used, in principle, provided that they permit the necessary fine control. This is true, in principle, for electromagnetic and electronic systems, for fluid systems, as well as for purely mechanical application of activating forces of all kinds.

Figure 5:
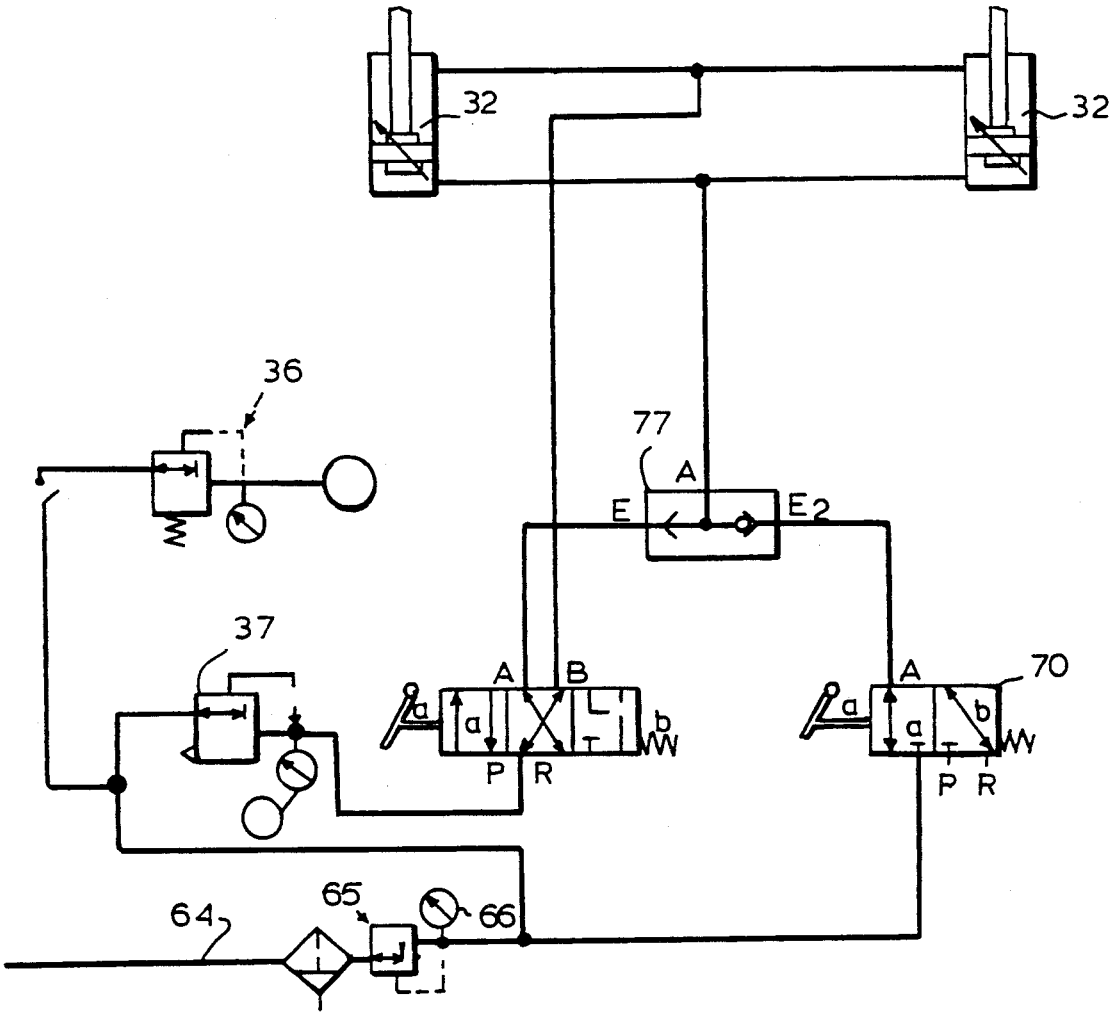

FIG. 5 is a pneumatic circuit plan, which may be employed for carrying out the present invention.

In FIG. 5, the main conduit (64) has a filter pressure controller (65) with a manometer (66). Via the pressure controlling valve (33), which is connected to the fabric web brake (36), as are the 4/3-way valve (69), connected downstream, and the 3/2-way valve (70); the latter both being, in turn, connected with the change valve (71). The change valve (71) controls the compressed air cylinder (32) shown in the top left of FIG. 5. A second compressed air cylinder (32) is shown in the top right of FIG. 5, with the 3/2-way valve (70) being shown on the right side of this figure.

While only several embodiments of the present invention have been shown and described, it will be obvious to those of ordinary skill in the art that many modifications may be made to the present invention without departing from the spirit and scope thereof.

| Summary of Reference Numerals in Drawing Figures |
|---|
| 1 Weaving machine |
| 2 Centered winder |
| 3 Floor surface |
| 4 Housing |
| 5 Dancer Roller Arrangement |
| 6 Dancer Roller |
| 7 Footbridge |

-continued

| Summary of Reference Numerals in Drawing Figures |
|---|
| 8 Web of fabric |
| 9 Exit roll |
| 10 Entrance roll |
| 11 Switch cabinet |
| 13 Traversing roll |
| 14 Winding axis |
| 15 Reversing roller |
| 16 Winding shaft |
| 17 Tilting bearing |
| 18 Floor frame |
| 19 End disk |
| 20 Winding drum |
| 21 Roll of fabric |
| 24 Electric motor |
| 25 Chain drive |
| 26 Pressure roller |
| 27 Bearing bolt |
| 28 Bearing |
| 29 Rocker mounting |
| 30 Lever |
| 31 Bearing |
| 32 Compressed Air Cylinder |
| 33 Pressure Control Valve |
| 34 Control Valve |
| 35 Rubber covering |
| 37/371 Partitioning Disks |
| 38 Drum tube |
| 39 Rubber covering |
| 40 Braking disk |
| 41 Braking caliper |
| 42/421 Caliper lever |
| 43 Linkage |
| 44 Brake pad |
| 45 Cross bar |
| 46 Knee lever linkage |
| 47 Double arrows |
| 49 Short-path compressed air cylinder |
| 50 Bolt |
| 51 Recess |
| 52 Contact Roll |
| 53 Web leader |
| 55 First take-up device |
| 56 Second take-up device |
| 57 Dancer weights |
| 59 Traversing device |
| 60 Disk drive |
| 61 Chain |
| 62 Sprocket wheel |
| 63 Sprocket wheel |

What is claimed is:

1. Apparatus for taking up a web of fabric, comprising:

a centered winder having a take-up drum placed after a weaving machine, said centered winder having a winding drum rotatable about a fixed winding axis to which the web of fabric is conveyed;

means for controlling the tensile strength of the web of fabric when the web of fabric is conveyed;

a pressure roller lying on the circumference of said winding drum or a roll of cloth on said winding drum; and, means for braking the web of fabric prior to a point where the web of fabric runs onto said winding drum, said means for braking the web of fabric being in a braking relationship with said pressure roller located at a point in a moving direction of said web ahead of said winding drum.

2. The apparatus according to claim 1, wherein the web of fabric wraps around said pressure roller at an angle of greater than 240°.

3. The apparatus according to claim 2, wherein the web of fabric wraps around said pressure roller at an angle of greater than 260° C.

4. The apparatus according to claim 1, further comprising a contact roller wherein the web of fabric is moved along over said contact roller until the web of fabric is close to the circumference of said winding drum, the web of fabric being further moved around said contact roller and then around said pressure roller through a gap between said pressure roller and said winding drum at its circumference.

5. The apparatus according to claim 1, further comprising displacement means for applying said pressure roller to said winding drum and to move said pressure roller away therefrom with means for controlling displacement force.

6. The apparatus according to claim 5, wherein said displacement means has a pressure-medium cylinder which is attached to a roller mounting, which carries said pressure roller.

7. Apparatus for taking up a web of fabric, comprising:

a centered winder having a take-up drum placed after a weaving machine, said centered winder having a winding drum rotatable about a fixed winding axis to which the web of fabric is conveyed;

means for controlling the tensile strength of the web of fabric when the web of fabric is conveyed;

a pressure roller lying on the circumference of said winding drum or a roll of cloth on said winding drum; and, means for braking the web of fabric prior to a point where the web of fabric runs onto said winding drum, said means for braking including a disk brake with a braking disk being connected with said pressure roller.

8. The apparatus according to claim 7, further comprising two brake pads at an edge of said braking disk, said two brake pads being connected on opposite sides to two longitudinal levers on which a motorized activating means acts in an opposing manner.

9. The apparatus according to claim 8, wherein said motorized activating means includes a hydraulic engine with pressure regulating means.

10. The apparatus according to claim 9, wherein said hydraulic engine is constructed as a short-path displacement device.

11. The apparatus according to claim 10, wherein said short-path displacement device includes flow means.

12. The apparatus according to claim 10, wherein said short-path displacement device is a compressed-air cylinder.

13. The apparatus according to claim 8, further comprising a roller mounting wherein said pressure roller is mounted on said roller mounting around an axis of rotation parallel to its mounting axis and that said motorized activating means for said braking means is attached to said roller mounting.

14. The apparatus according to claim 7, further comprising displacement means for applying said pressure roller to said winding drum and to move said pressure roller away therefrom with means for controlling displacement force.

15. The apparatus according to claim 14, wherein said displacement means has a pressure-medium cylinder which is attached to a roller mounting, which carries said pressure roller.

* * * * *